US007841034B1

(12) United States Patent
Stelter

(10) Patent No.: US 7,841,034 B1
(45) Date of Patent: Nov. 30, 2010

(54) FENCE CLEANER

(76) Inventor: Mark Stelter, P.O. Box 400, Bismarck, ND (US) 58502-0400

( * ) Notice: Subject to any disclaimer, the term of this patent is extended or adjusted under 35 U.S.C. 154(b) by 436 days.

(21) Appl. No.: 12/153,626

(22) Filed: May 22, 2008

(51) Int. Cl.
*B08B 7/00* (2006.01)

(52) U.S. Cl. ..... 15/3; 15/88.4

(58) Field of Classification Search ..... 15/3, 15/88.4

See application file for complete search history.

(56) References Cited

U.S. PATENT DOCUMENTS 5,651,156 A * 7/1997 Oomura ..... 15/21.1

* cited by examiner

*Primary Examiner*—Monica S Carter
*Assistant Examiner*—Stephanie Newton

(57) ABSTRACT

Disclosed is a vehicle drawn device for cleaning a fence line. The fence cleaner includes a movable main frame with an attached rotating vertical tube broom which tube broom bristles come into contact with the fence line to remove dead and dried out vegetation which has become affixed to the fence line. The tube broom is capable of being tilted for better access to a fence line. Once the vegetation is removed from the fence line by the tube broom, the tube broom rotates the dead and dried out vegetation to a rotating clean off assembly. The clean off assembly extends parallel to the tube broom and contains a plurality of protruding teeth. The protruding teeth remove the dead and dried out vegetation from the rotating tube broom and force the vegetation into a chopper drum. A rotating horizontal feed accelerator continuously pushes the vegetation into the drum to avoid a buildup of vegetation. Upon entering the drum, a plurality of chopping blades cut the dead and dried out vegetation into small sections. Once chopped, the vegetation sections drop to ground level and are ultimately tilled into the ground.

14 Claims, 5 Drawing Sheets

FENCE CLEANER

BACKGROUND OF THE INVENTION

Field of the Invention

This invention relates to a novel and useful fence cleaner and more specifically to a fence cleaner designed primarily for the purpose of removing dead and dried out vegetation, such as tumbleweeds, from a fence line of the type including spaced upright posts interconnected by means of vertically spaced and generally horizontal members extending between adjacent posts of the fence and then mulching the removed vegetation and placing the mulch on the ground.

In many localities barbed wire or wire fence of the type including upstanding vertically spaced posts and horizontally spaced strands of barbed wire or wire extending between adjacent posts are utilized to define certain field areas, either individual field areas or boundary lines between adjacent field areas.

When this type of fence construction, as well as other types of fence construction, is utilized to define a boundary line of a field, tumbleweeds and other dried out and uprooted vegetation will be blown across the field and become stuck or attached to the fence wire. An accumulation of such vegetation blown onto the fence wire can cause the fence wire to break or come detached from the fence post or can cause the fence post to be bent or broken.

The prior art proposes inventions for removing living ground vegetation from beneath and about a fence line. One such apparatus is shown in U.S. Pat. No. 2,314,215 by Hilblom. In this apparatus, Hilblom uses a caster wheel on the frame end to follow the ground level and support the weight of the cutter. In U.S. Pat. No. 4,573,306 by Smith et al, Smith uses a gearing system to power multiple ground vegetation cutters. U.S. Pat. No. 2,052,802 to Schartz; Is a weed and vine cutter in which Schartz uses a rotating disc as a cutter. He tilts the disc (as if plowing a field) and cuts below the surface of the ground thus severing the roots of weeds or vines. He supports his invention using a caster wheel, and the device is powered by a chain drive system. U.S. Pat. No. 4,901,508 to Whatley. Whatley uses a plurality of horizontal rotating blades, each mounted on a vertical stub axis and arranged in a circular array such that when a fence post is encountered, the mechanism rotates around the post. U.S. Pat. No. 5,050,372 to Heiskell. Heiskell uses a flexible reinforced rubber to cut ground-level vegetation.

While the prior art may be remotely successful in removing vegetation growing from the ground beneath the fence line, the prior art does not address the problem of removing tumbleweeds and other dead vegetation attached to all portions of the fence line. Furthermore, use of the prior art to remove the dead vegetation would simply result in the vegetation adjacent to the bottom fence line being removed from the fence line and then placed back into the field. Thus, when the wind blows, the previously removed vegetation would once again become attached to the fence line.

To permanently remove the vegetation from the fence line, individuals were required to either burn the dead and dried vegetation or hand pick the vegetation and discard it in a distant location. The burning of dried out vegetation is not an environmentally sound practice and creates the danger of the fire becoming uncontrolled, thereby creating a danger to individuals and adjacent property. Likewise, hand collecting the dead and dried out vegetation is not a realizable practice since the fence line may extend for several miles.

SUMMARY OF THE INVENTION

A fence cleaner assembly according to the present invention includes a movable main frame with an attached rotating vertical tube broom which bristles come into contact with the fence line to remove dead and dried out vegetation which has become affixed to the fence line. The tube broom is capable of being tilted for better access to a fence line. Once the vegetation is removed from the fence line by the tube broom, the tube broom rotates the dead and dried out vegetation to a rotating clean off assembly.

The clean off assembly extends parallel to the tube broom and contains a plurality of protruding teeth. The protruding teeth remove the dead and dried out vegetation from the rotating tube broom and forces the vegetation into a chopping assembly. A rotating horizontal feed accelerator containing a plurality of protruding teeth, which is maintained at the entry point of the chopping assembly, continuously pushes the vegetation into the chamber so as to avoid a buildup of vegetation. Upon entering the chopping drum of the chopper assembly, a plurality of removable chopping blades cut the dead and dried out vegetation into small sections. Once properly chopped, the vegetation sections drop to ground level and are ultimately tilled into the ground. The small size of the dead and dried out vegetation sections will no longer cause a problem along the fence line.

In the preferred embodiments of the present invention, the rotation of the tube broom and clean off assembly are powered by a hydraulic motor. Likewise, the tilting of the tube broom and clean off assembly is powered with a hydraulic cylinder.

Accordingly, it is the primary objective of the present invention to provide a mechanical fence cleaner which will be operative to remove dead and dried out vegetation, such as tumbleweeds, from a fence line and then mulch or crush the removed vegetation so it will not be capable of reattaching to the fence line.

Another object of the present invention is to provide a fence cleaner which will be operative to traverse one side of a fence and remove and mulch the dead and dried out vegetation attached thereto.

A further object of the present invention is to provide a fence cleaner adapted specifically to be partially supported from and propelled by an ordinary piece of farm equipment, such as a farm tractor, thereby enabling the fence cleaner to be readily utilized in conjunction with existing equipment.

A further object of the present invention is to provide a fence cleaner which will conform to conventional forms of manufacture, be of simple construction and easy to use so as to provide a device that will be economically feasible, long lasting and relatively trouble-free in operation.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

DETAILED DESCRIPTION OF THE PREFERRED EMBODIMENTS

The present invention and the various features and advantageous details thereof are explained more fully with reference to the non-limiting embodiments described in the following description.

FIGS. 1 through 10 show a device of the present invention which can be used for easily removing dead and dried out vegetation, such as tumbleweeds, attached to a fence line of the type including spaced upright posts interconnected by means of vertically spaced and generally horizontal members extending between adjacent posts of the fence.

Figure 1:
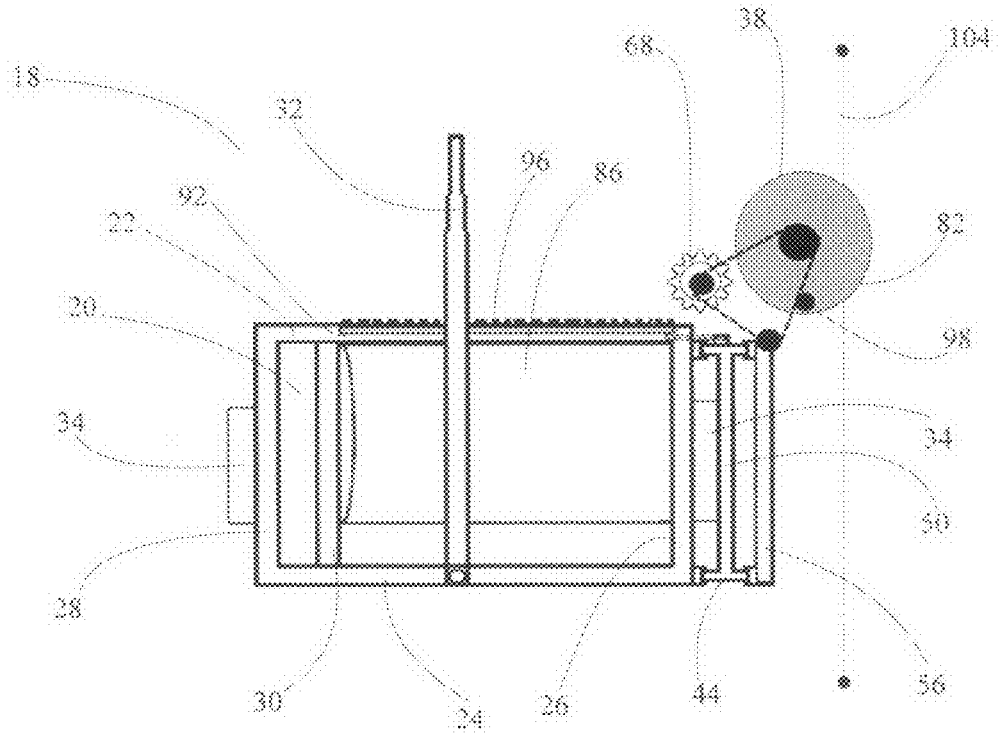
FIG. 1 is a top perspective view of the fence cleaner assembly in accordance with the preferred embodiments of the present invention.

Referring to FIG. 1, the device consists of a rectangular shaped main frame 20 having a front end 22, a back end 24, a first side 26 and a second side 28 with one or more cross members 30; a tongue assembly 32 attached to the back end 24 of main frame; and at least one pair of wheels 34. The tongue assembly 32 is rotatably attached to the back end 24 of the main frame 20 near the second side 28.

Figure 2:
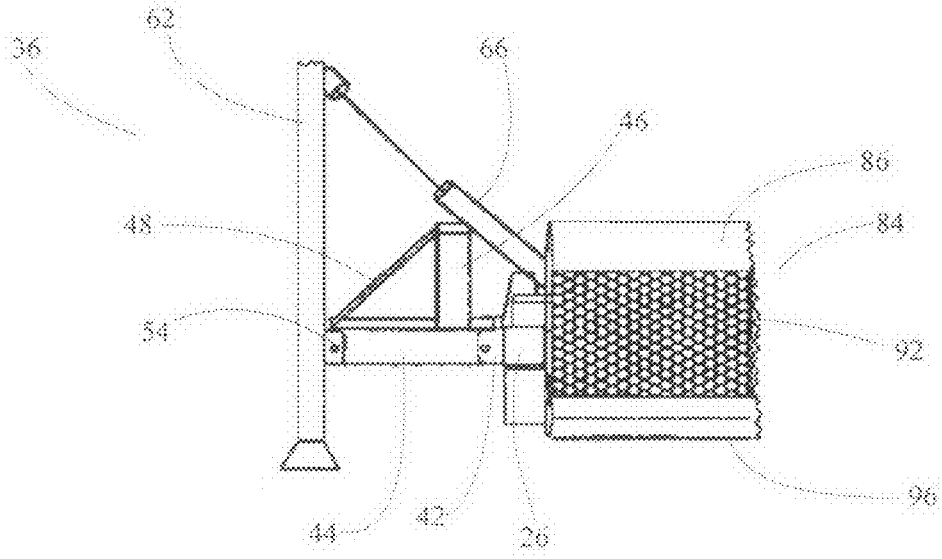
FIG. 2 is a front perspective view of the tilt assembly in accordance with the preferred embodiments of the present invention.
Figure 3:
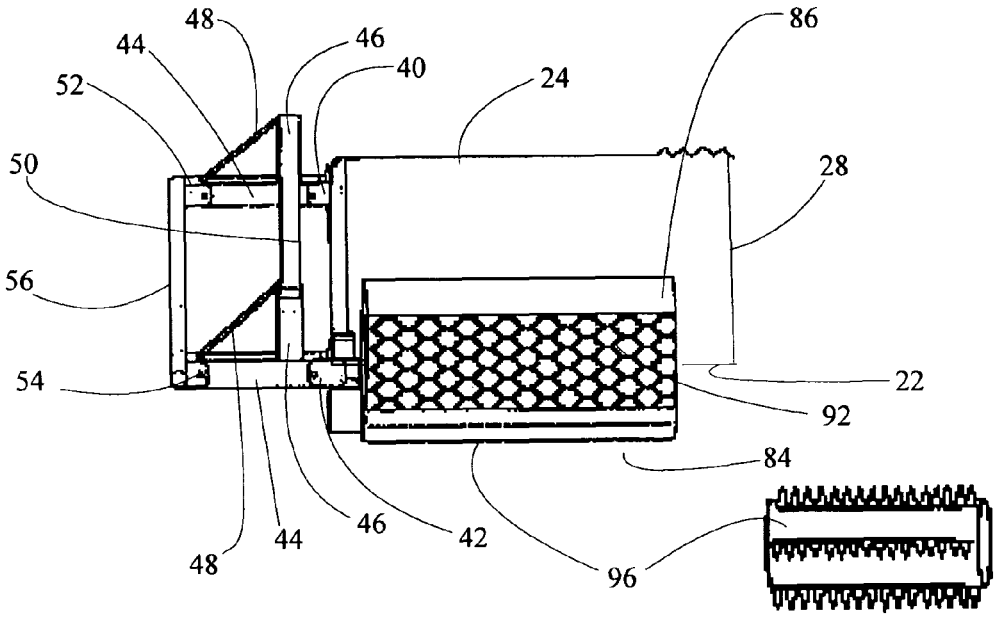
FIG. 3 is a front perspective view of the tilt assembly, screen, horizontal feed accelerator, and chopping chamber in accordance with the preferred embodiments of the present invention.
Figure 10:
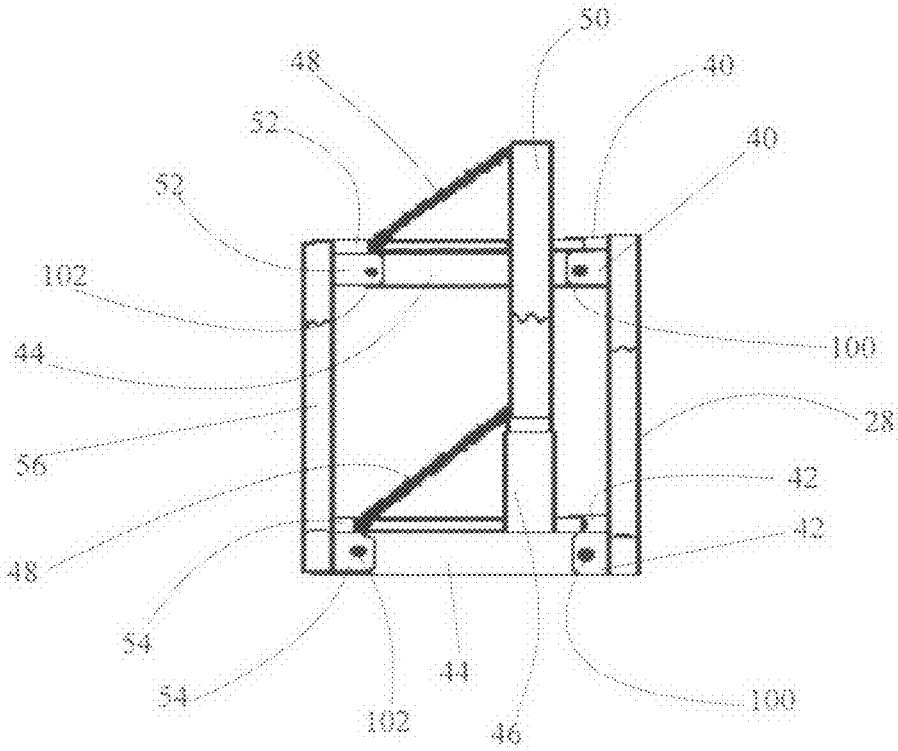
FIG. 10 is a top perspective view of the tilting assembly in accordance with the preferred embodiments of the present invention.

Referring to FIGS. 2, 3 and 10, maintained on the first side 26 of the main frame 20 is a tilting assembly 36 which allows the user to adjust the angle of the tube broom 38 when cleaning a fence line. The tilting assembly 36 is comprised of a first pair of connector plates 40 and a second pair of connector plates 42 with each plate 40, 42 having a first end and a second end with a circular opening adjacent to said second end.

The first ends of the first connector plates 40 are fixedly attached to the first side 26 of the main frame 20 near the back end 24 in spaced proportion with the second end of the first connectors 40 extending perpendicular from the first side 26. The first ends of the second connector plates 42 are fixedly attached in spaced relation to the first side 26 of the main frame 20 near the front end 22 with the second end of the second connectors 42 extending perpendicular from the first side 26.

As illustrated in FIG. 10, rotatably attached to the second ends of the first and second connector plates 40, 42 are horizontal tubing sections 44 having a first open end and a second open end. Each horizontal tubing section 44 contains circular openings adjacent to the first and second open ends. Fixedly attached to the top side of each horizontal tubing section 44, near the first open end, is the bottom end of a vertical tubing section 46. An angular rigid support strap 48 extends from the top end of the vertical tubing section 46 to a point adjacent to the second open end of the horizontal tubing section 44. A bracing member 50 is fixedly attached to the top ends of the vertical tubing sections 46.

The first ends of the horizontal tubing sections 44 are inserted between the second ends of the first and second connector plates 40, 42. Bolts 100 are inserted in the aligned openings of the first and second connector plates 40, 42 and horizontal tubing sections 44 resulting in the horizontal tubing sections 44 being rotatable about the first and second connector plates 40, 42.

The tilting assembly 36 is further comprised of a longitudinal tubing section 56 having a first end and a second end and extending parallel to the first side 26 of the main frame 20. Fixedly attached to the longitudinal tubing section 56 adjacent to its first end in spaced relation are a third pair of connector plates 52. Fixedly attached to the longitudinal tubing section adjacent to its second end in spaced relation are a fourth pair of connector plates 54.

The third and fourth pairs of connector plates 52, 54 extend perpendicular from the longitudinal tubing section 56 with each such connector plate 52, 54 containing a circular opening. Rotatably attached between the spaced third connector plates 52 is the second open end of a horizontal tubing section 44. Likewise, rotatably attached between the spaced fourth connector plates 54 is the second open end of a horizontal tubing section 44. A bolt 102 is inserted in the aligned openings of the third connector plates 52 and the horizontal tubing section 44. Similarly, a bolt 102 is inserted in the aligned openings of the fourth connector plates 54 and the horizontal tubing section 44.

Figure 4:
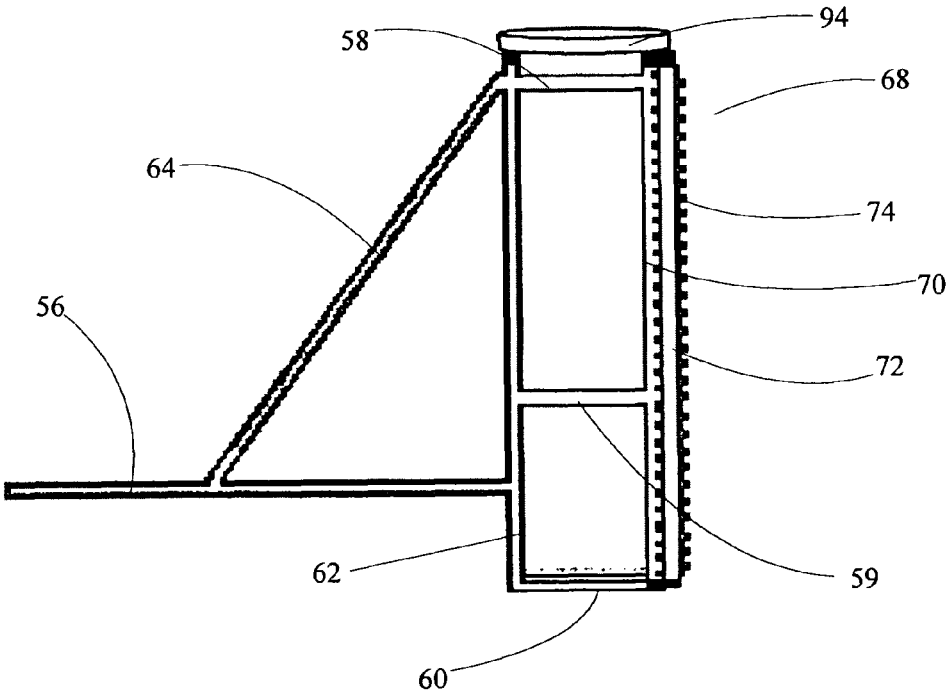
FIG. 4 is a side perspective view of the tube broom support assembly in accordance with the preferred embodiments of the present invention.
Figure 5:
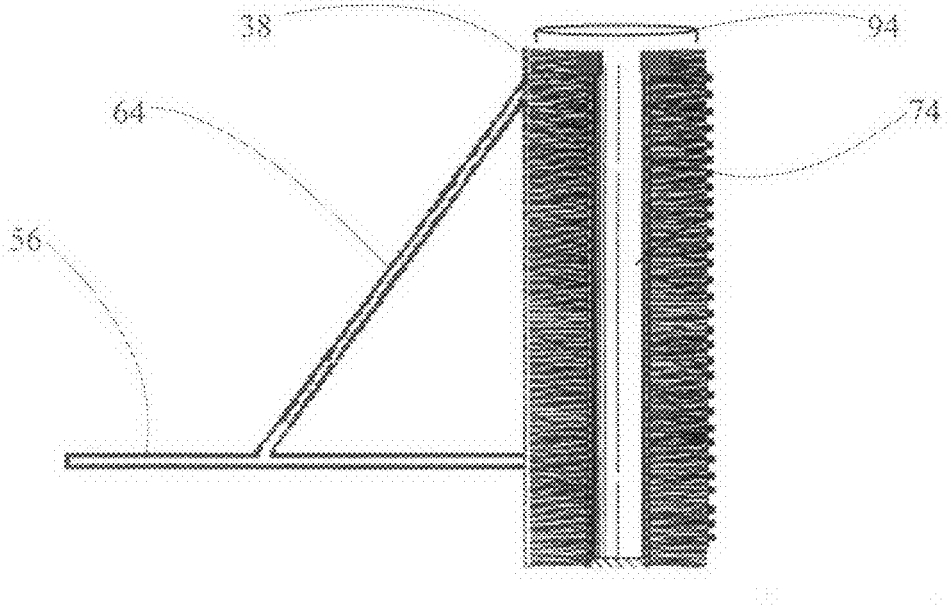
FIG. 5 is a side perspective view of the tube broom support assembly and tube broom in accordance with the preferred embodiments of the present invention.
Figure 7:
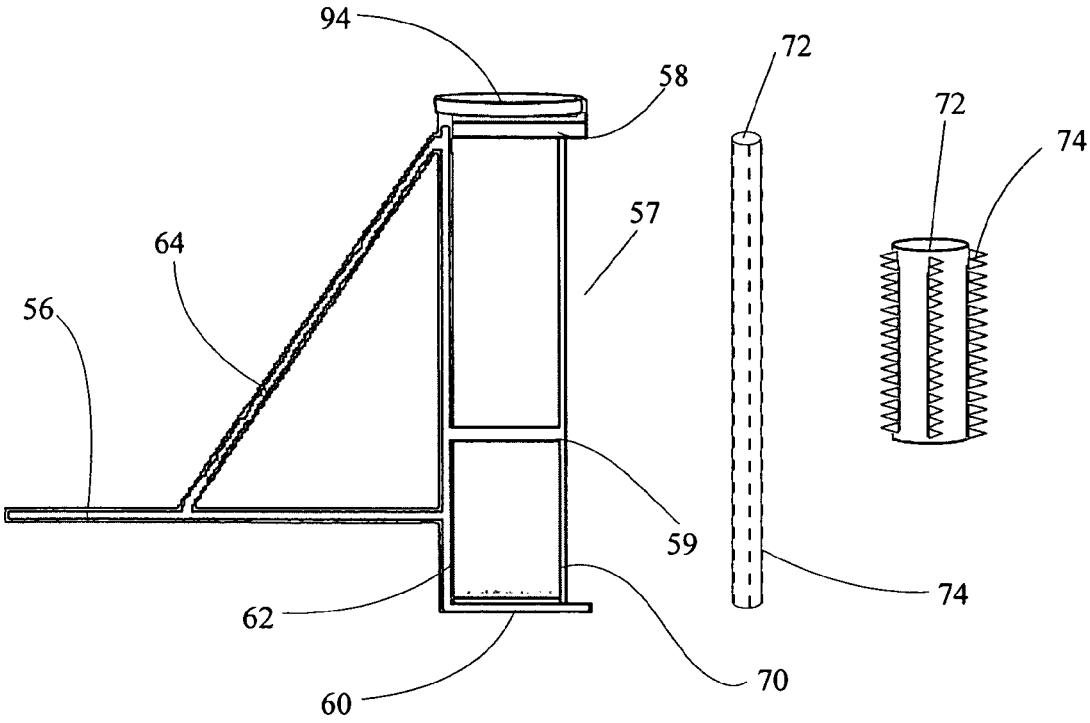
FIG. 7 is a front perspective view and an exploded view of the clean off assembly in accordance with the preferred embodiments of the present invention.

Referring to FIGS. 4, 5 and 7, fixedly attached to the first end of the longitudinal tubing section 56 is the tube broom and broom clean off assembly frame 57. The tube broom and broom clean off assembly frame 57 is comprised of vertically extending first support bar 62 and vertically extending second support bar 70. The first and second vertically extending support bars 62, 70 are maintained in spaced relation with a horizontally extending top bar 58, an intermediate bar 59, and a bottom bar 60. The horizontal top bar 58, intermediate bar 59 and bottom bar 60 are fixedly attached to the vertical support bars 62, 70.

As illustrated in FIG. 4, the first support bar 62 is fixedly attached to the first end of the longitudinal tubing section 56. To maintain the tube broom frame and broom clean off frame 57 in an upright position, an angled stabilizer bar 64 having a first end and a second end extends from the top end of the first support bar 62 to a point near the middle of the longitudinal tubing section 56. To rotate the tube broom and broom clean off assembly frame 57 about a horizontal pivot axis, the first end of a hydraulic cylinder 66 is removably attached to the front end 22 of the main frame 20 and the second end of the hydraulic cylinder 66 is removably attached to the first support bar 62.

The extension of the hydraulic cylinder 66 causes the longitudinal tubing section 56 and horizontal tubing sections 44 to rotate about the connector plates 40, 42, 52, 54. Through such rotation, the tube broom frame and broom clean off frame assembly 57 can be raised, lowered and angled to properly removed the dead and dried vegetation from the fence 104.

Referring to FIGS. 1 and 5, a tube broom 38 is removably maintained within the tube broom and broom clean off assembly frame 57 by means of securing devices contained on the top bar 58 and bottom bar 60. Adjacent to the tube broom 38 and also maintained within the tube broom and broom clean off assembly frame 57 is the clean off assembly 68. As illustrated in FIG. 7, the clean off assembly 68 is comprised of a vertically extending cylindrical section of tubing 72 to which are fixedly attached a plurality of teeth 74.

Figure 6:
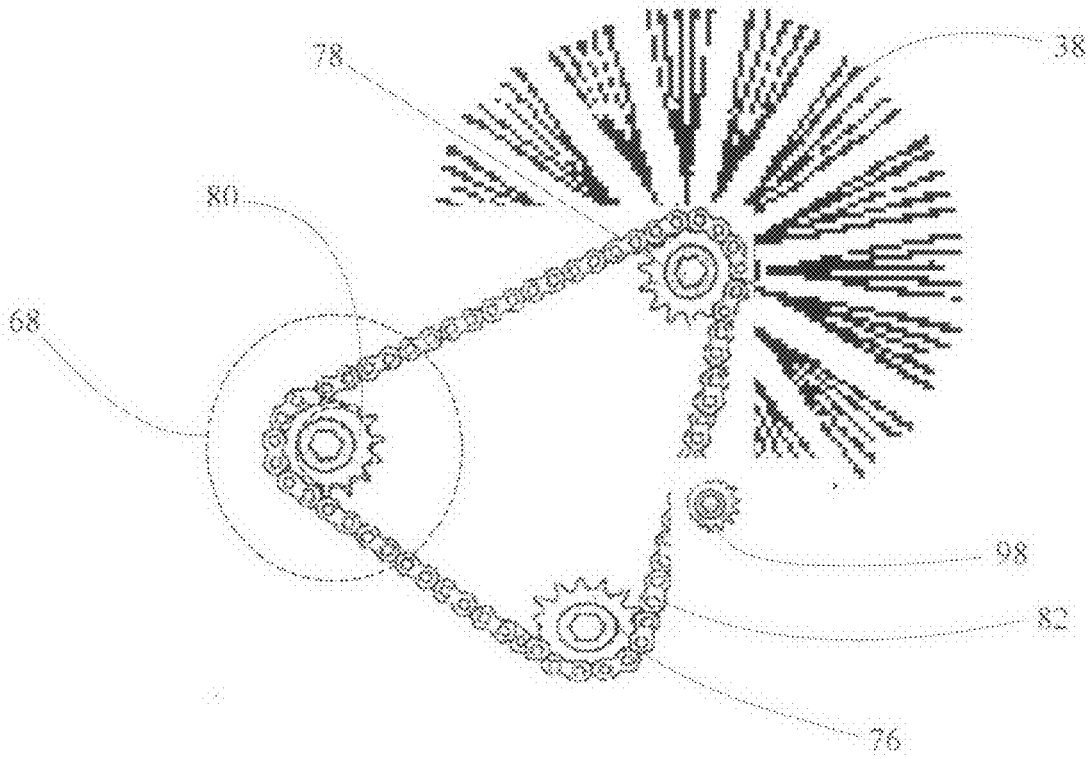
FIG. 6 is a top perspective view of the drive sprocket, tube broom sprocket, cleaning rod sprocket and chain in accordance with the preferred embodiments of the present invention.

Referring to FIG. 6, the drive means for rotating the tube broom 38 and clean off assembly 68 includes a hydraulic motor (not shown) having a chain sprocket 76 for driving the tube broom sprocket 78 and the clean off assembly sprocket 80. The tube broom sprocket 78 is removably attached to the top end of the tube broom 38. Likewise, the clean off assembly sprocket 80 is removably attached to the clean off assembly 68. The drive motor is run at a speed whereby the tube broom sprocket 78 and clean off assembly sprocket 80 are rotated at a desired rpm by means of a chain 82. To maintain the desired tension between the chain 82 and the sprockets 76, 78, 80, a chain tightener 98 may be incorporated. The chain sprocket 76, tube broom sprocket 78, clean off assembly sprocket 80 and chain 82 are maintained within a sprocket housing 94, see FIGS. 4 and 5, which is removably attached above the top bar 58 of the tube broom and broom clean off assembly frame 57.

In operation, the tube broom 38 and clean off assembly 68 are rotating as the fence cleaner assembly 18 is towed by a tractor or similar towing vehicle along a fence line 104. The tube broom 38 and clean off assembly 68 can be angled closer to the fence line by rotating the tilting assembly 36 by means of the hydraulic cylinder 66. As the tube broom 38 rotates and removes the vegetation from the fence line 104, the vegetation will attach to the tube broom 38. While rotating on the tube broom 38, the vegetation will come into contact with the clean off assembly 68 and be removed from the tube broom 38. The clean off assembly 68 will cause the vegetation to drop to the ground in front of the chopper assembly 84.

Figure 8:
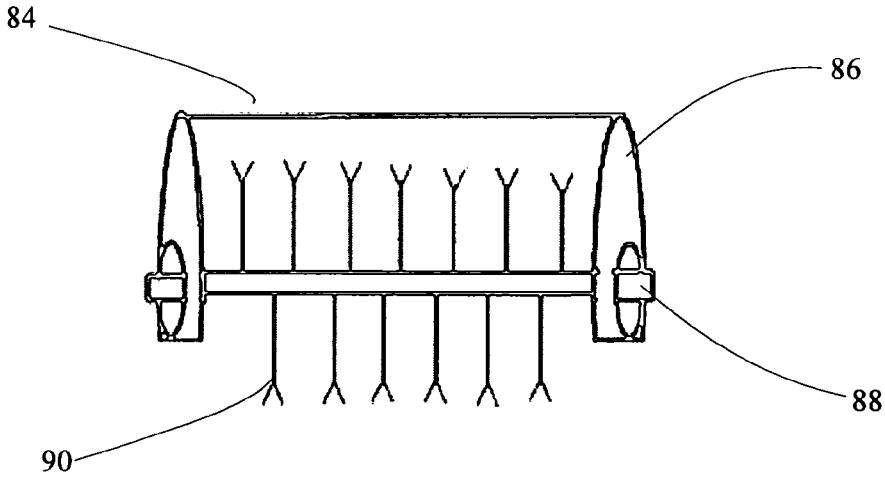
FIG. 8 is a front perspective view of the chopping chamber in accordance with the preferred embodiments of the present invention.
Figure 9:
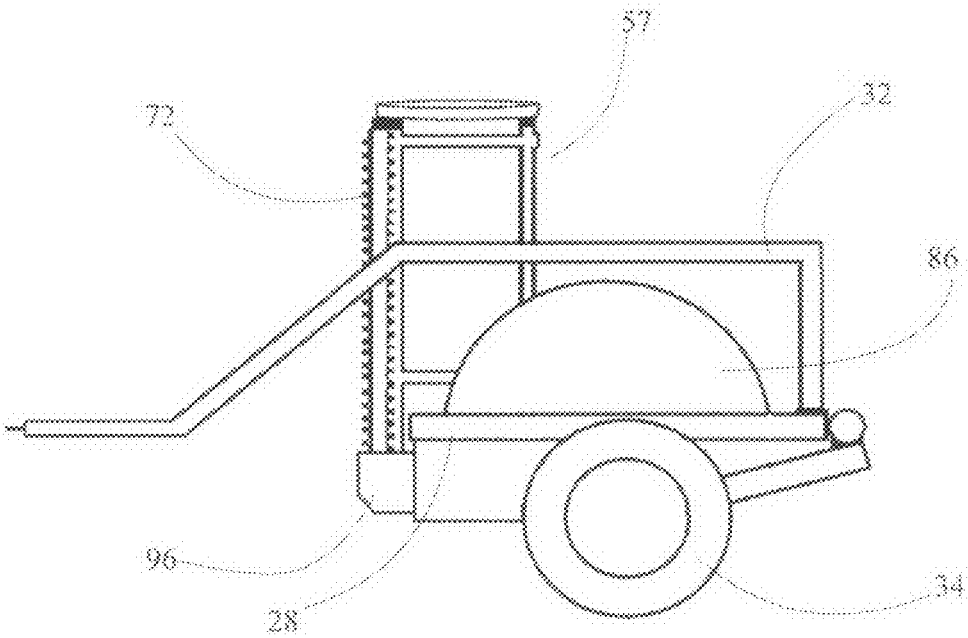
FIG. 9 is a side perspective view of the fence cleaner assembly in accordance with the preferred embodiments of the present invention.

Referring to FIGS. 2, 3, and 8, the chopper assembly 84 is comprised of a chopping drum 86 which supports and contains a rotating shaft 88 to which a plurality of chopping blades 90 are attached. The chopper assembly 84 is supported by and fixedly attached to the front end 22 and first side 26 frame members of the main frame 20. Also located on the front end 22 in front of the chopping drum 86 is a screen 92. The screen 92 forces weeds coming off of the clean off assembly 68 to drop downward instead of falling onto the main frame 20.

To force the weeds into the chopping drum 86, a horizontal feed accelerator 96 is utilized. The horizontal feed accelerator 96 is comprised of a cylindrical section of tubing to which are fixedly attached a plurality of teeth. The horizontal feed accelerator 96 is powered by a hydraulic motor (not shown). As the horizontal feed accelerator 96 rotates, its teeth cause weeds to be pushed into the chopping drum 86.

The rotating shaft 88 of the chopper assembly 84 is comprised of a single longitudinally extending shaft operatively coupled to a drive motor (not shown). The rotating shaft 88 is supported by bearing blocks at either end thereof. As illustrated in FIG. 8, the rotating shaft 88 has fixedly attached to it a series of removable chopping blades 90.

When the weeds are removed from the tube broom 38 by the clean off assembly 68 and dropped to ground level in front of the chopper assembly 84 the forward advancement of the fence cleaner assembly 18 along with the horizontal feed accelerator 96 cause the weeds to enter the chopping drum 86 at which time the weeds are chopped into small sections by the chopping blades 90. Once the weeds have been chopped, they drop out of the chopping drum 86 and remain on the ground.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept.

The individual components mentioned herein need not be fabricated from the disclosed materials, but could be fabricated from virtually any suitable and strong materials.

Moreover, the individual components need not be formed in the disclosed shapes, or assembled in the disclosed configuration, but could be provided in virtually any shape, and assembled in virtually any suitable configuration. It is intended that the appended claims cover all such additions, modifications and rearrangements.

Index of Fence Cleaner Assembly Elements

| | |
|---|---|
| 18. | Fence Cleaner Assembly |
| 20. | Main Frame |
| 22. | Main Frame Front End |
| 24. | Main Frame Back End |
| 26. | Main Frame First Side |
| 28. | Main Frame Second Side |
| 30. | Main Frame Cross Members |
| 32. | Tongue Assembly |
| 34. | Wheels |
| 36. | Tilting Assembly |
| 38. | Tube Broom |
| 40. | First Connector Plates |
| 42. | Second Connector Plates |
| 44. | Horizontal Tubing Section |
| 46. | Vertical Tubing Section |
| 48. | Angular Rigid Support Strap |
| 50. | Bracing Member |
| 52. | Third Connector Plates |
| 54. | Fourth Connector Plates |
| 56. | Longitudinal Tubing Section |
| 57. | Tube Broom Frame |
| 58. | Top Bar |
| 59. | Intermediate Bar |
| 60. | Bottom Bar |
| 62. | First Support Bar |
| 64. | Stabilizer Bar |
| 66. | Hydraulic Cylinder |
| 68. | Clean Off Assembly |
| 70. | Second Support Bar |
| 72. | Cylindrical Tubing |
| 74. | Teeth |
| 76. | Chain Sprocket |
| 78. | Tube Broom Sprocket |
| 80. | Clean Off Assembly Sprocket |
| 82. | Chain |
| 84. | Chopper Assembly |
| 86. | Chopping Drum |
| 88. | Rotating Shaft |
| 90. | Chopping Blades |
| 92. | Screen |
| 94. | Sprocket Housing |
| 96. | Horizontal Feed Accelerator |
| 98. | Chain Tightener |
| 100. | Bolt |
| 102. | Bolt |
| 104. | Fence |

What is claimed is:

1. A fence cleaner assembly for quickly and easily removing tumbleweeds and other dead vegetation attached to a fence line which is comprised of:

a rectangular shaped main frame having a front end, a back end, a first side and a second side with one or more cross members, a tongue assembly attached to the back end of said main frame, and at least one pair of wheels;

a tilting assembly maintained on the first side of the main frame comprised of:

a first pair of connector plates with each such plate having a first end and a second end with a circular opening adjacent to said second end and which first ends are fixedly attached to the first side of the main frame in spaced relation with the second end of the first connectors extending perpendicular from the first side;

a second pair of connector plates with each such plate having a first end and a second end with a circular opening adjacent to said second end and which first ends are fixedly attached to the first side of the main frame in spaced relation with the second end of the second connectors extending perpendicular from the first side;

horizontal tubing sections having a first open end, a second open end, a top side and a bottom side with circular openings adjacent to said first and second open ends which horizontal tubing sections are rotatably attached to the second ends of the first and second connector plates;

vertical tubing sections having a top end and a bottom end with said bottom ends fixedly attached to the top side of the horizontal tubing sections;

angular rigid support straps which support straps extend from the top ends of the vertical tubing sections to the top sides of the horizontal tubing sections;

a longitudinal tubing section having a first end and a second end;

a third pair of connector plates fixedly attached in spaced relation to the longitudinal tubing section adjacent to the longitudinal tubing section's first end which connector plates extend perpendicular to the longitudinal tubing section with each such plate containing a circular opening;

a fourth pair of connector plates fixedly attached in spaced relation to the longitudinal tubing section adjacent to the longitudinal tubing section's second end which connector plates extend perpendicular to the longitudinal tubing section with each such plate containing a circular opening;

rotatably attached between the third connector plates is the second open end of a horizontal tubing section; and rotatably attached between the fourth connector plates is the second open end of a horizontal tubing section;

a tube broom and broom clean off assembly frame comprised of:

a vertically extending first support bar fixedly attached to the first end of the longitudinal tubing section;

a vertically extending second support bar;

a top bar;

an intermediate bar;

a bottom bar; and an angled stabilizer bar having a first end and a second end with said first end fixedly attached to the vertically extending first support bar and said second end fixedly attached to the longitudinal tubing section;

a hydraulic cylinder having a first end and a second end;

a tube broom having a top end and a bottom end with a sprocket removably attached to said top end;

a clean off assembly comprised of:

a vertically extending cylindrical section of tubing having a top end and a bottom end with a sprocket removably attached to said top end; and a plurality of teeth fixedly attached to the cylindrical section of tubing;

a drive means for rotating the tube broom and clean off assembly;

a chopper assembly fixedly attached to the front end and first side frame members of the main frame comprised of a chopping drum;

a horizontal shaft;

a plurality of chopping blades fixedly attached to the horizontal shaft;

a screen; and a horizontal feed accelerator comprised of a cylindrical section of tubing to which are fixedly attached a plurality of teeth.

2. A fence cleaner assembly as claimed in claim 1 in which the tongue assembly is rotatably attached to the back end of the main frame near the second side.

3. A fence cleaner assembly as claimed in claim 1 in which the first ends of the horizontal tubing sections are inserted between the second ends of the first and second connector plates, bolts are inserted in the aligned openings of the first and second connector plates and horizontal tubing sections resulting in the horizontal tubing sections being rotatable about the first and second connector plates.

4. A fence cleaner assembly as claimed in claim 1 in which the second ends of the horizontal tubing sections are inserted between the second ends of the third and fourth connector plates, bolts are inserted in the aligned openings of the third and fourth connector plates and horizontal tubing sections resulting in the horizontal tubing sections being rotatable about the third and fourth connector plates.

5. A fence cleaner assembly as claimed in claim 1 in which the horizontal top bar, intermediate bar, and bottom bar are fixedly attached to the vertically extending first support bar and the vertically extending second support bar.

6. A fence cleaner assembly as claimed in claim 1 in which to rotate the tube broom and broom clean off assembly frame about a horizontal pivot axis, the first end of the hydraulic cylinder is removably attached to the front end of the main frame and the second end of the hydraulic cylinder is removably attached to the first support bar wherein the extension of the hydraulic cylinder causes the longitudinal tubing section and horizontal tubing sections to rotate about the connector plates causing the tube broom frame and broom clean off frame assembly to be raised, lowered and angled.

7. A fence cleaner assembly as claimed in claim 1 in which the tube broom is removably maintained on the tube broom and broom clean off assembly frame by means of securing devices contained on the top bar and bottom bar.

8. A fence cleaner assembly as claimed in claim 1 in which the drive means for rotating the tube broom and clean off assembly includes a hydraulic motor having a chain sprocket for driving the tube broom sprocket and the clean off assembly sprocket.

9. A fence cleaner assembly for quickly and easily removing tumbleweeds and other dead vegetation attached to a fence line which is comprised of:

a rectangular shaped main frame having a front end, a back end, a first side and a second side with one or more cross members, a tongue assembly attached to the back end, and at least one pair of wheels;

a tube broom frame;

a tube broom removably attached to the tube broom frame which tube broom has a top end and a bottom end with a sprocket removably attached to said top end;

a broom clean off comprised of a vertically extending cylindrical section of tubing having a top end and a bottom end which section of tubing contains a plurality of teeth and a sprocket removably attached to said top end;

a tilting assembly for properly rotate the tube broom and broom clean off assembly about a horizontal pivot axis;

a hydraulic cylinder which assists in the movement of the tilting assembly;

a drive means for rotating the tube broom and clean off assembly; and a chopper assembly fixedly attached to the front end and first side frame members of the main frame comprised of a chopping drum;

a horizontal shaft;

a plurality of chopping blades fixedly attached to the horizontal shaft;

a screen; and a horizontal feed accelerator comprised of a cylindrical section of tubing to which are fixedly attached a plurality of teeth.

10. A fence cleaner assembly as claimed in claim 9 in which the tilting assembly is comprised of:

a first pair of connector plates with each such plate having a first end and a second end with a circular opening adjacent to said second end and which first ends are fixedly attached to the first side of the main frame in spaced relation with the second end of the first connectors extending perpendicular from the first side;

a second pair of connector plates with each such plate having a first end and a second end with a circular opening adjacent to said second end and which first ends are fixedly attached to the first side of the main frame in spaced relation with the second end of the second connectors extending perpendicular from the first side;

horizontal tubing sections having a first open end, a second open end, a top side and a bottom side with circular openings adjacent to said first and second open ends which horizontal tubing sections are rotatably attached to the second ends of the first and second connector plates;

vertical tubing sections having a top end and a bottom end with said bottom ends fixedly attached to the top side of the horizontal tubing sections;

angular rigid support straps which support straps extend from the top ends of the vertical tubing sections to the top sides of the horizontal tubing sections;

a longitudinal tubing section having a first end and a second end;

a third pair of connector plates fixedly attached in spaced relation to the longitudinal tubing section adjacent to the longitudinal tubing section's first end which connector plates extend perpendicular to the longitudinal tubing section with each such plate containing a circular opening;

a fourth pair of connector plates fixedly attached in spaced relation to the longitudinal tubing section adjacent to the longitudinal tubing section's second end which connector plates extend perpendicular to the longitudinal tubing section with each such plate containing a circular opening;

rotatably attached between the third connector plates is the second open end of a horizontal tubing section; and rotatably attached between the fourth connector plates is the second open end of a horizontal tubing section.

11. A fence cleaner assembly as claimed in claim 9 in which the drive means for rotating the tube broom and clean off assembly includes a hydraulic motor having a chain sprocket for driving the tube broom sprocket and the clean off assembly sprocket.

12. A fence cleaner assembly as claimed in claim 9 in which a tube broom frame is comprised of:

a vertically extending first support bar fixedly attached to the first end of the longitudinal tubing section;

a vertically extending second support bar;

a top bar;

an intermediate bar;

a bottom bar; and an angled stabilizer bar.

13. A fence cleaner assembly as claimed in claim 12 in which the horizontal top bar, intermediate bar, and bottom bar are fixedly attached to the vertically extending first support bar and the vertically extending second support bar.

14. A fence cleaner assembly for quickly and easily removing tumbleweeds and other dead vegetation attached to a fence line which is comprised of:

a rectangular shaped main frame having a front end, a back end, a first side and a second side with one or more cross members, a tongue assembly attached to the back end, and at least one pair of wheels;

a rotating and tilting vertical tube broom attached to the main frame which tube broom rotates about a fence line to remove dead and dried out vegetation, such as tumbleweeds;

a rotating and tilting vertical broom clean off comprised of a vertically extending cylindrical section of tubing containing a plurality of teeth which broom clean off is adjacent to and parallel with the vertical tube broom and removes the dead and dried out vegetation from the vertical tube broom;

a hydraulic cylinder to assist in tilting the vertical tube broom and the vertical broom clean off;

a drive means for rotating the vertical tube broom and vertical broom clean off; and a chopper assembly into which the dead and dried out vegetation is directed by the vertical broom clean off for purposes of cutting the vegetation into small pieces which chopper assembly is fixedly attached to the front end and first side frame members of the main frame and comprised of a chopping drum;

a horizontal shaft;

a plurality of chopping blades fixedly attached to the horizontal shaft;

a screen; and a horizontal feed accelerator comprised of a cylindrical section of tubing to which are fixedly attached a plurality of teeth.

* * * * *